United States Patent [19]

Lindermann et al.

[11] 3,943,634

[45] Mar. 16, 1976

[54] DEVICE FOR MEASURING AND CONTROLLING THE GAP BETWEEN ROLLERS IN A ROLLER STAND

[75] Inventors: Herbert Lindermann, Rheinhausen; Ludwig Niemeyer, Essen, both of Germany

[73] Assignee: Fried. Krupp Gesellschaft mit beschrankter Haftung, Essen, Germany

[22] Filed: Dec. 2, 1974

[21] Appl. No.: 528,998

[30] Foreign Application Priority Data

Dec. 18, 1973 Germany ..... 2362805

[52] U.S. Cl. ..... 33/182; 72/21

[51] Int. Cl.[2] ..... B21B 37/08

[58] Field of Search .. 33/182, 143 R, 143 L, 147 L, 33/DIG. 2; 226/181, 189, 194; 198/167; 72/21

[56] References Cited

UNITED STATES PATENTS 3,817,068 6/1974 Meyer ..... 33/182

*Primary Examiner*—Richard E. Aegerter
*Assistant Examiner*—Willis Little
*Attorney, Agent, or Firm*—Walter Becker

[57] ABSTRACT

A device for measuring the gap between the rollers in a roller stand for developing a value for use in controlling the gap in which the device comprises respective relatively moveable elements connected to half bearings engaging the shafts of a pair of opposed rollers. The half bearings are pressed outwardly into engagement with the shafts and at least one of the aforementioned elements is adjustably connected to the respective half bearing.

8 Claims, 3 Drawing Figures

DEVICE FOR MEASURING AND CONTROLLING THE GAP BETWEEN ROLLERS IN A ROLLER STAND

The present invention relates to an arrangement of measured value indicators for controling the roller gap in roller stands in which on each side of the roller stand between the body of working surface of the working rollers and the installation parts therefor in the roller stand, i.e., within the region of the roller ends or roller necks there is provided a measured value indicator which comprises two indicator units which are located opposite to each other and cooperate with each other.

German Offenlegungsschrift No. 21 12 981 describes an arrangement of measured value indicators for the control of a roller gap, especially of multi-roller stands in which between the installation part and the roller body there is located the upper portion of an indicator housing which more specifically is in a play-free manner mounted on the roller end of the upper roller whereas the lower part of the indicator housing is in a play-free manner journaled on the roller end of the lower roller. Each of both parts is connected with one holding arm projecting forwardly in rolling direction and with a holding arm projecting rearwardly while between said two arms there is provided a measured value indicator. Both mountings for the indicator housing are preferably horizontally divided while the respective outer bearing box is linked to that joint or parting line of the indicator housing which in the direction of rotation of the roller end is located in front, and on the rear joint or parting line is under spring pressure connected to said indicator housing.

Due to the construction of the bearing areas of the holding arms which bearing areas are designed as gauging ring, unavoidable disorders in the function occur which unfavorably affect measured results furnished by the measured value indicator. The following disorder-causing factors occur: the rotation preventing safety devices of the gauge or measuring rings which devices are arranged on the installation parts of the working rollers, follow the movements of the installation parts and displace the measuring plane between the upper and the lower measuring indicators. The axial bearing play between the working roller bearings and the roller ends bring about measuring errors.

Since the measuring rings for the upper and lower working rollers are independent of each other which means that each measuring or gauging ring follows only the axial movement of the roller with which it is associated, measuring errors occur due to the displacement of the measured value indicators cooperating with each other.

The total of all tolerances between the working rollers and the rolling stands depends on the technically possible precision and the ability of all employed machine elements such as working rollers, working roller bearings, installation parts, etc., to maintain their dimensions and locations.

Inasmuch as each working roller has two bearing points which are oriented in conformity with a fixed point, and more specifically on the inner side of the roller stand window which receives the installation parts, the rotating working roller will carry out a wabbling movement. This wabbling movement will with both working rollers appear to a different extent and thus determines the mutual displacement and the setting of the working rollers relative to each other.

The measuring rings which are positively connected to the working rollers follow all wabbling movements of the rollers. The measured value indicators arranged in the measuring rings automatically follow said wabbling movement whereby the furnished measured values will be continuously changed.

It is an object of the present invention to provide an arrangement of the measured value indicators, by means of which an improvement in the measuring prerequisites and thus a better quality of the rolled products will be assured.

These and other objects and advantages of the invention will appear more clearly from the following specification in connection with the accompanying drawings, in which.

Figure 1:
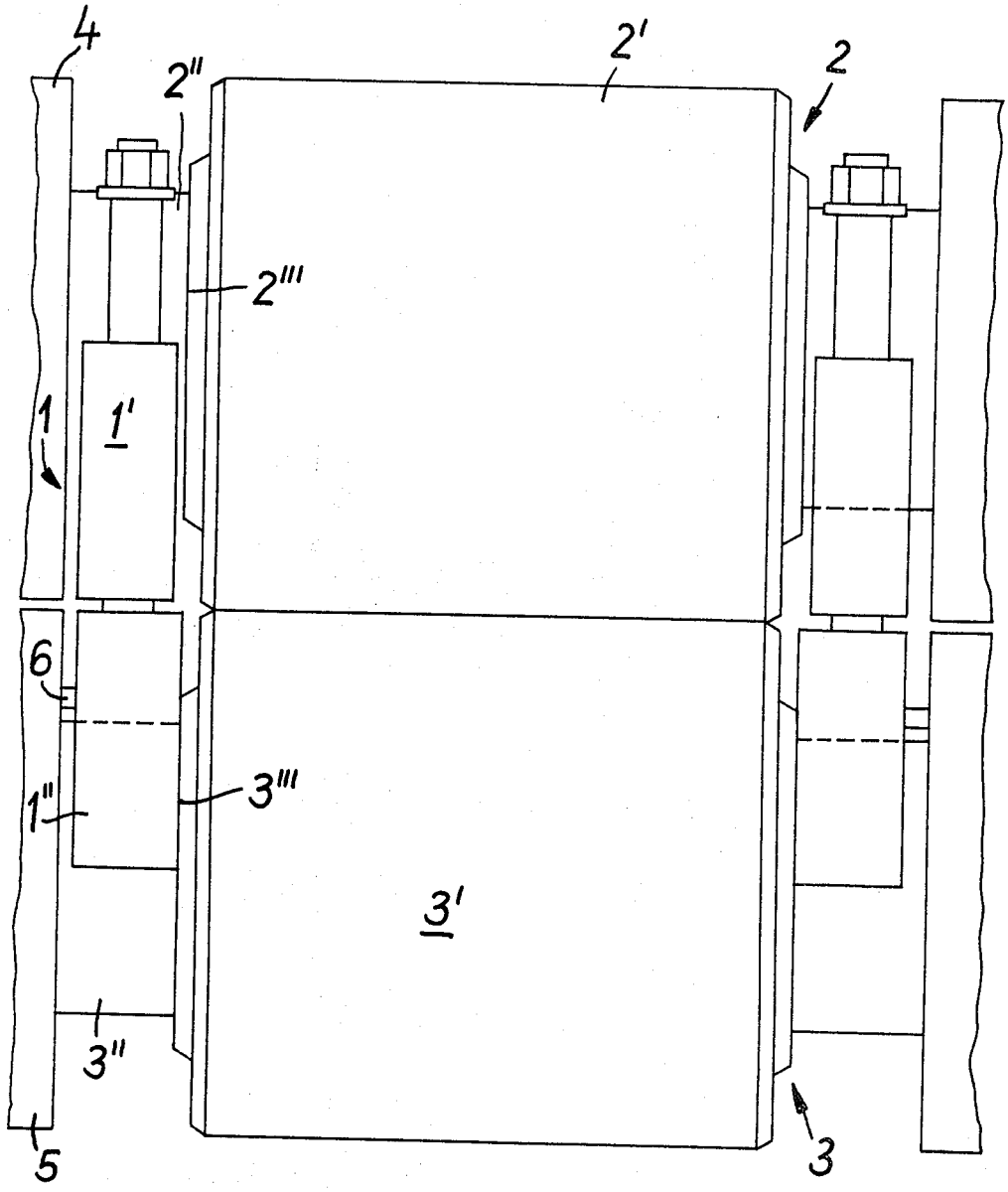
FIG. 1 is an end view of the working rollers, of the measuring bridges and of the schematically indicated installation parts of the roller stand of a roller framework.

The arrangement of the measured value indicator for the control of the roller gap in the rolling stands is, according to the present invention, characterized primarily in that the measured value indicator is arranged in a measuring bridge which comprises an upper part and a lower part which are arranged opposite to each other and which respectively through a bearing half shell rests on the lower and upper circumferential half of the roller end of the upper and lower working roller respectively while the engagement of the roller ends thereby is secured by preloaded spring elements provided between both measuring parts, one measuring bridge part being displaceably held by guiding means fixedly connected to the other measuring bridge part so as to be vertically displaceable relative to said other bridge part in vertical direction, in other words perpendicularly with regard to the rolling plane.

Expediently, one of the indicator units is by means of an adjusting device arranged in the pertaining measuring bridge part, connected and by the latter is displaceable in vertical direction.

The adjusting device permits the gauging of the measured value indicator. The working rollers are first by moving together brought to the so-called zero position, and subsequently the movable indicator unit is brought to engagement on the other indicator unit which is non-movably held in the pertaining measuring bridge part.

As measured value indocator for a contact-free measurement of the distance between the working rollers, advantageously light electrical or electromagnetical pulse emitters may be employed. However, also other suitable measured value indicators may be employed.

A preferred further development of the subject matter according to the invention consists in that one of the measuring bridge parts is through a spring device resting against the roller stand caused to engage the oppositely located end face of the roller body which belongs to the pertaining working roller. Between the other measuring bridge part and the end face of the roller body of the pertaining working roller there is provided a distance equalling a plurality of a few millimeters.

The last mentioned working roller is, however, able to move freely relative to the pertaining measuring bridge part, in other words in axial direction.

The indicator unit held movably in the pertaining measuring bridge part is preferably connected to two hydraulically operable adjusting pistons which by means of a spring loaded clamping jaw is adapted to be held fast in the corresponding measuring bridge part. When turning off the oil pressure acting upon the adjusting pistons, the movable indicator unit is automatically arrested in that position which it occupies in this instance.

According to a preferred embodiment of the invention, the guiding means for the movable measuring bridge part consists of two guiding rods with end abutment which guiding rods engage corresponding bores of the measuring bridge part and which through a supporting plate are screwed to one of the measuring bridge parts.

Figure 2:
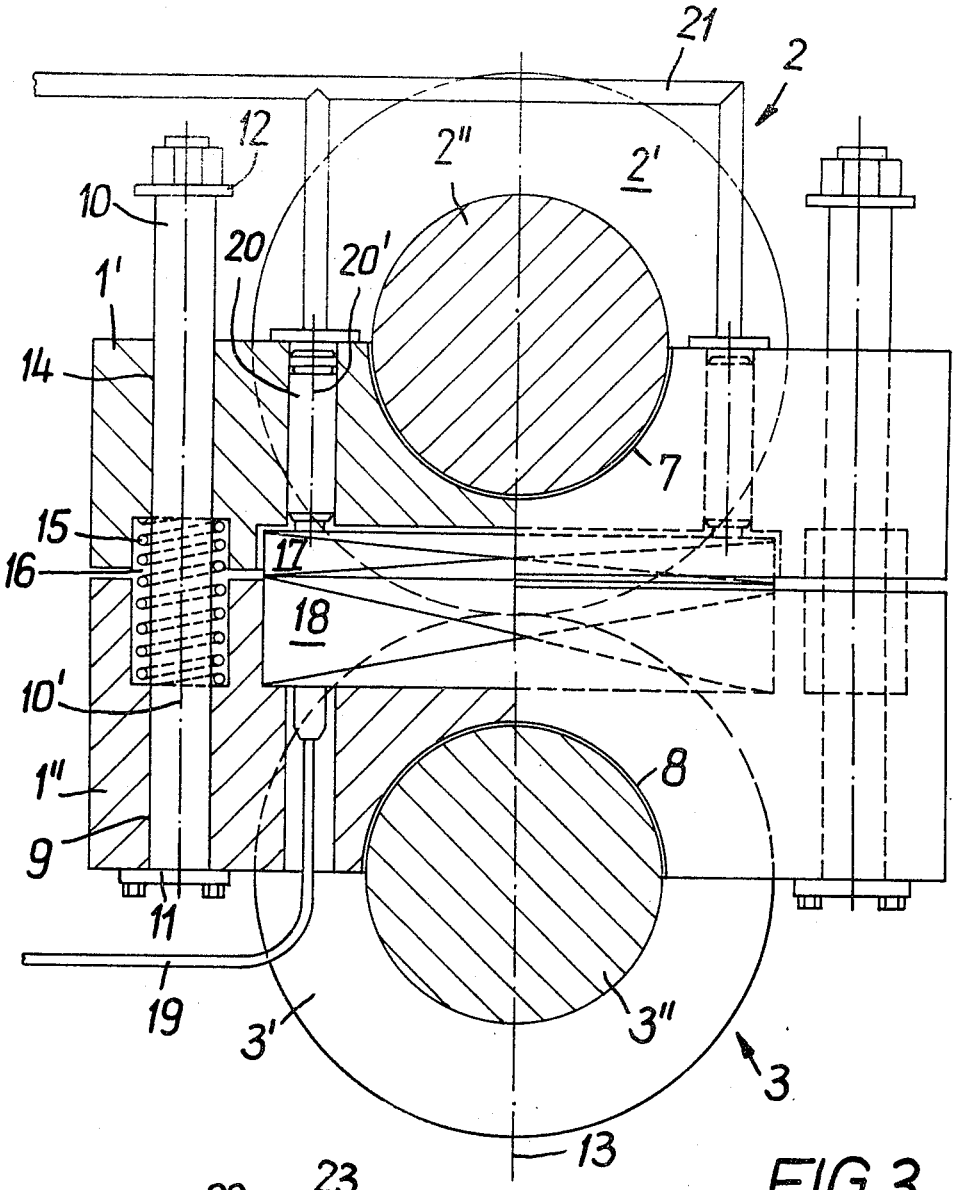
FIG. 2 is a side view of the working rollers and of the measuring bridge (partially sectioned).
Figure 3:
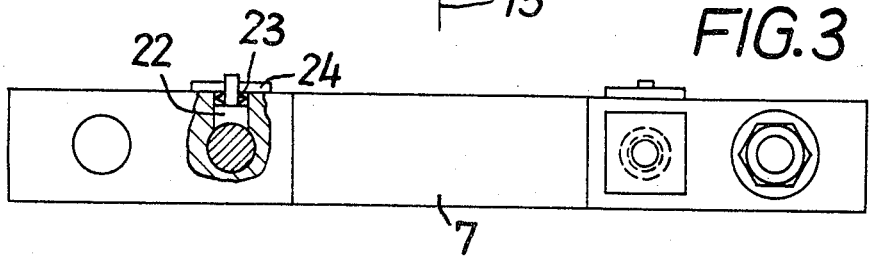
FIG. 3 is a top view of the upper portion of the measuring bridge.

Referring now to the drawings in detail, the measuring bridges 1 which respectively comprise a measuring bridge upper part 1' and a measuring bridge lower part 1'' associated with the measuring bridge upper part 1' are arranged between the bodies 2' and 3' of the upper working roller 2 and lower working roller 3 and the pertaining installation parts 4, 5 within the region of the shaft ends 2'', and 3''. The measuring bridge part 1'' is by means of a spring device 6, resting against the inner surface of the pertaining assembly part 5, brought into engagement with the end face 3''' of the body 3'. The spring device 6 may consist of a spring loaded bolt which is horizontally movable. Between the end face 2''' of the body 2' and the lateral surface of the measuring bridge part 1' which lateral surface is located opposite to said end face there is provided a distance of about 5mm. The upper working roller 2 may consequently move freely in axial direction without affecting the measuring bridge 1 (FIG. 1). The measuring bridge parts 1' and 1'' respectively rest by means of a bearing half shell 7 or 8 against the lower or upper circumferential half of the roller ends 2'' and 3'' respectively. The openings of the bearing half shells 7 and 8 are thus directed away from each other as shown in FIG. 2. Two bores 9 are arranged in the measuring bridge part 1'' outside the region of the roller bodies. In these bores there are respectively resting guiding rods 10. The guiding rods are by means of a supporting plate 11 connected thereto screwed to the bottom side of the measuring bridge part 1''. The guiding rods 10, the upper end of which is provided with a screwed on end abutment 12, are arranged vertically which means their bottom axes 10' extend parallel to the plane 13 which is determined by the axes of the two working rollers 2 and 3.

The guiding rods 10 engage bores 14 of the measuring birdge part 1' and permit a play-free vertical displacement thereof. The maximum possible distance between the measuring bridge part 1' and 1'' is determined by the end abutment 12.

The guiding rods 10 simultaneously serve for centering of pressure springs 15 arranged between the two measuring bridge parts. These pressure springs 15 press the cooperating measuring bridge parts 1' and 1'' apart from each other and thereby cause the circumferential bridge parts 1' and 1'' to engage the circumferential surfaces of the roller ends 2'' and 3''.

The pressure springs 15 which comprise cylindrical helical springs are respectively arranged in a recess 16 between the two measuring bridge parts.

The measuring bridge parts 1' and 1'' are within the region between the guiding rods 10 and between the roller ends 2'' and 3'' equipped with an indicator unit 17, 18 respectively which together form the measured value indicator for controlling the roller gap between the bodies 2' and 3' of the working rollers 2, 3.

The lower indicator unit 18 which by means of a gap 19 is connected to a control device (not shown) is not movable relative to the pertaining measuring bridge part 1''.

The upper indicator unit 17 is connected to two adjusting pistons 20 the axes 20' of which are likewise parallel to the plane 13. The adjusting pistons may through the intervention of a conduit system 21 be acted upon unilaterally by hydraulic oil under pressure and thus may be moved within the measuring bridge part 1'. The conduit system 21 is through the intervention of a magnetic valve connected to a hydraulic energy set (not illustrated). One clamping jaw 22 each rests against the adjusting pistons 20 below the chamber filled with oil under pressure. The pressing surface of the clamping jaw 22 has the same curvature as the pertaining adjusting piston. The necessary pressing force is generated by a preloaded pressure spring 23 which on one hand rests against the clamping jaw and on the other hand rests against a cover 24 which is firmly connected to the measuring bridge part 1'. The clamping jaws 22 are intended to maintain the indicator unit 17, after switching off the pressure oil in the conduit system 21, in the respective position it occupies at the respective instant.

The measured value indicator is gauged in the following manner: first, the working rollers 2 and 3 are moved together into their zero position. The adjusting pistons 20 are after opening of a magnet valve acted upon by a pressure fluid whereby the upper indicator unit 17 is pressed downwardly until it rests against that countersurface of the lower indicator unit 18 which is directed upwardly. Subsequently, the magnet valve is closed whereby the pressure prevailing in the conduit system 21 is reduced.

If now the working rollers are moved away from each other by the roller gap, the indicator unit 17 is by means of othe clamping jaws 22 held fast in the said zero position. The air gap between the two indicator units 17, 18 and the roller gap between the bodies 2', 3' of the working rollers 2, 3 are consequently of equal magnitude.

If the zero position of the upper indicator unit 17 is during the rolling operation changed by outer influences, the gauging operation may be repeated without, as was heretofore necessary, moving the roller set out of the roller stand for purposes of being able to readjust the upper measuring value indicators.

The newly suggested arrangement according to the invention has the advantage that the movements of the installing parts no longer can act as interfering elements because the entire measuring bridge rests on the roller ends. The two first interfering disorder factors are thus eliminated.

The interfering factor "wobbling movement" is within the arrangement according to the invention automatically converted into a vertically oscillating movement because the measuring bridge construction due to the guiding rods, permits only a vertical movement. Each movement of the two working rollers is thus converted into a genuine vertically measurable value. The three-dimensional changes of the measuring plane between the upper and lower measuring value indicators, which change occurs with heretofore known measuring or gauging rings, has according to the present invention been reduced to a one-dimensional change.

It is, of course, to be understood that the present invention is, by no means, limited to the specific showing in the drawings, but also comprises any modifications within the scope of the appended claims.

What is claimed is:

1. In combination with a roller stand defining the axes of a pair of opposed rollers whose shafts are mounted therein, a device for measuring and controlling changes in the gap between said opposed rollers, said device comprising first and second partial bearings engaging the sides of the shafts of the rollers which face each other, first and second measuring bridge parts, first and second measuring elements mounted on said bridge parts and connected to the respective partial bearings, preloaded spring means arranged between said first and second elements for biasing said partial bearing away from each other whereby said partial bearings and the respective said elements connected thereto will move relatively in conformity with relative movement of the rollers, and guide means guiding said bearing portions for relative movement in a direction parallel to a vertical plane of the axes of the rollers.

2. A device in combination according to claim 1 which includes means for adjusting one of said elements on the respective bridge parts in a vertical direction relative to a plane through the roller axes in which plane relative movement of said bridge parts occurs vertically.

3. A device in combination according to claim 1 in which the rollers have end faces and biasing means is provided acting on one of said bridge parts to hold the respective bridge parts against the end face of the respective roller, the other partial bearing being axially spaced a short distance from the end face of the roller pertaining thereto.

4. A device in combination according to claim 2 which includes a pair of plungers reciprocable in one of said bridge parts and connected to the respective said element for movement of the said element in a direction parallel to said plane, and spring loaded clamping means in one of said bridge parts and engaging said plungers to hold said plungers in adjusted positions.

5. A device in combination according to claim 1 in which said guide means comprise a pair of guide rods in parallel spaced relation and extending through bores provided in said bridge parts, said guide rods at one end being fixed to one of said bridge parts.

6. A device in combination according to claim 1 in which said guiding means comprises guide rod means parallel to said plane and said spring means comprise helical compression springs surrounding said rod means and at opposite ends bearing on said bridge parts.

7. A device in combination according to claim 2 in which said partial bearings are half bearings formed in respective blocks on the side of the blocks which face away from each other, said blocks having said elements connected thereto on the sides of the blocks which face each other.

8. A device in combination according to claim 7 in which each block is elongated in a direction perpendicular to said plane, said guide means comprising a rod parallel to said plane near each end of said blocks, said elements extending longitudinally on said blocks and through said plane.

* * * * *